US009969578B2

(12) United States Patent
Kinoshita

(10) Patent No.: US 9,969,578 B2
(45) Date of Patent: May 15, 2018

(54) SHEET FEEDING APPARATUS AND IMAGE FORMING APPARATUS

(71) Applicant: CANON KABUSHIKI KAISHA, Tokyo (JP)

(72) Inventor: Takeshi Kinoshita, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days. days.

(21) Appl. No.: 15/254,687

(22) Filed: Sep. 1, 2016

(65) Prior Publication Data

US 2017/0066612 A1 Mar. 9, 2017

(30) Foreign Application Priority Data

Sep. 8, 2015 (JP) ..... 2015-176859

(51) Int. Cl.

| | |
|---|---|
| ***B65H 1/28*** | (2006.01) |
| ***B65H 7/06*** | (2006.01) |
| ***B65H 1/04*** | (2006.01) |
| ***B65H 1/30*** | (2006.01) |
| ***G03G 15/00*** | (2006.01) |

(52) U.S. Cl.

CPC ..... *B65H 1/28* (2013.01); *B65H 1/04* (2013.01); *B65H 1/30* (2013.01); *B65H 7/06* (2013.01); *G03G 15/55* (2013.01); *G03G 15/6508* (2013.01); *G03G 15/6511* (2013.01); *B65H 2405/3311* (2013.01); *B65H 2405/351* (2013.01); *B65H 2405/361* (2013.01)

(58) Field of Classification Search

CPC ..... B65H 1/28; B65H 1/30; B65H 2404/733; B65H 2405/331; B65H 2405/3311; B65H 2405/351

See application file for complete search history.

(56) References Cited

U.S. PATENT DOCUMENTS 5,096,181 A * 3/1992 Menon ..... B65H 1/266 271/147
5,102,112 A * 4/1992 Takahashi ..... B65H 1/30 271/127
5,195,734 A * 3/1993 Tanabe ..... B65H 3/44 271/164

(Continued)

FOREIGN PATENT DOCUMENTS

JP 2625024 B2 6/1997

*Primary Examiner* — Jeremy R Severson

(74) *Attorney, Agent, or Firm* — Canon U.S.A., Inc. IP Division

(57) ABSTRACT

A sheet feeding apparatus includes a first tray on which sheets are stacked, a sheet feeder, a second tray on which sheets to be supplied to the first tray are stacked, wherein the second tray is disposed adjacently to the first tray, a sheet mover, an abnormality detector, and a controller. The sheet feeder feeds the sheets stacked on the first tray. The sheet mover moves the sheets stacked on the second tray. The sheet mover is movable between a first position for stacking sheets on the second tray and a second position for supplying the sheets stacked on the second tray to the first tray. The abnormality detector may detect an abnormality in the sheet mover. When the abnormality detector detects an abnormality in the sheet mover, the controller inhibits the sheet mover from operating and permits the sheet feeder to feed a sheet.

11 Claims, 4 Drawing Sheets

(56) References Cited

U.S. PATENT DOCUMENTS

| | | | | |
|---|---|---|---|---|
| 5,335,903 | A * | 8/1994 | Martin | B65H 1/266<br>271/157 |
| 6,332,609 | B1 * | 12/2001 | Arakawa | B65H 1/04<br>271/157 |
| 7,866,654 | B2 * | 1/2011 | Ohno | B65H 1/28<br>271/157 |
| 8,585,037 | B1 * | 11/2013 | Jacobs | B65H 1/28<br>271/157 |
| 2016/0257507 | A1 * | 9/2016 | Nakagawa | B65H 1/08 |
| 2017/0066612 | A1 * | 3/2017 | Kinoshita | B65H 7/06 |

* cited by examiner

SHEET FEEDING APPARATUS AND IMAGE FORMING APPARATUS

BACKGROUND OF THE INVENTION

Field of the Invention

An embodiment of the present invention relates to a sheet feeding apparatus and an image forming apparatus in which a sheet is fed from a sheet stacking portion receiving two stacks of sheets arranged side by side.

Description of the Related Art

A typical image forming apparatus, such as a copier or a printer, includes a sheet feeding apparatus that feeds sheets received in the feeder one by one to an image forming unit. The sheet feeding apparatus is required to receive a large amount of stacked sheets in order to reduce the frequency of sheet supply during job execution. In terms of the configuration of the sheet feeding apparatus, it is necessary to stack sheets vertically. To stack a large amount of sheets, the sheet feeding apparatus has to be increased in height, resulting in an increase in size of the sheet feeding apparatus.

Japanese Patent No. 2625024 describes a configuration in which a first sheet containing portion and a second sheet containing portion are arranged side by side, and when sheets in the first sheet containing portion are used up, sheets in the second sheet containing portion are moved to the first sheet containing portion to continue sheet feeding.

The configuration described in Japanese Patent No. 2625024 does not take into account the occurrence of an abnormality in a sheet supply mechanism. When an abnormality occurs in part of an apparatus, the apparatus is typically stopped. The apparatus is not released from such an abnormal state, for example, unless a main power switch of the apparatus is turned off and is then turned on. This reduces the usability of the apparatus. Particularly, if an abnormality is detected in the sheet supply mechanism after a print job is set, turning off the main power switch will delete the set print job.

SUMMARY OF THE INVENTION

Embodiments of the present invention provide a sheet feeding apparatus that eliminates a reduction in usability of the sheet feeding apparatus if an abnormality occurs in the movement of a sheet in a second sheet containing portion.

A first aspect of the present invention provides a sheet feeding apparatus including a first tray on which sheets are stacked, a sheet feeder configured to feed the sheets stacked on the first tray, a second tray on which sheets to be supplied to the first tray are stacked, wherein the second tray is disposed adjacently to the first tray, and a sheet mover configured to move the sheets stacked on the second tray. The sheet mover is movable between a first position for stacking sheets on the second tray and a second position for supplying the sheets stacked on the second tray to the first tray. The sheet feeding apparatus further includes an abnormality detector configured to detect an abnormality in the sheet mover, and a controller configured to, when the abnormality detector detects an abnormality in the sheet mover, inhibit the sheet mover from operating and permit the sheet feeder to feed a sheet.

Further features of the present invention will become apparent from the following description of exemplary embodiments with reference to the attached drawings.

DESCRIPTION OF THE EMBODIMENTS

Embodiments of the present invention will be described in detail with reference to the drawings.

Figure 1:
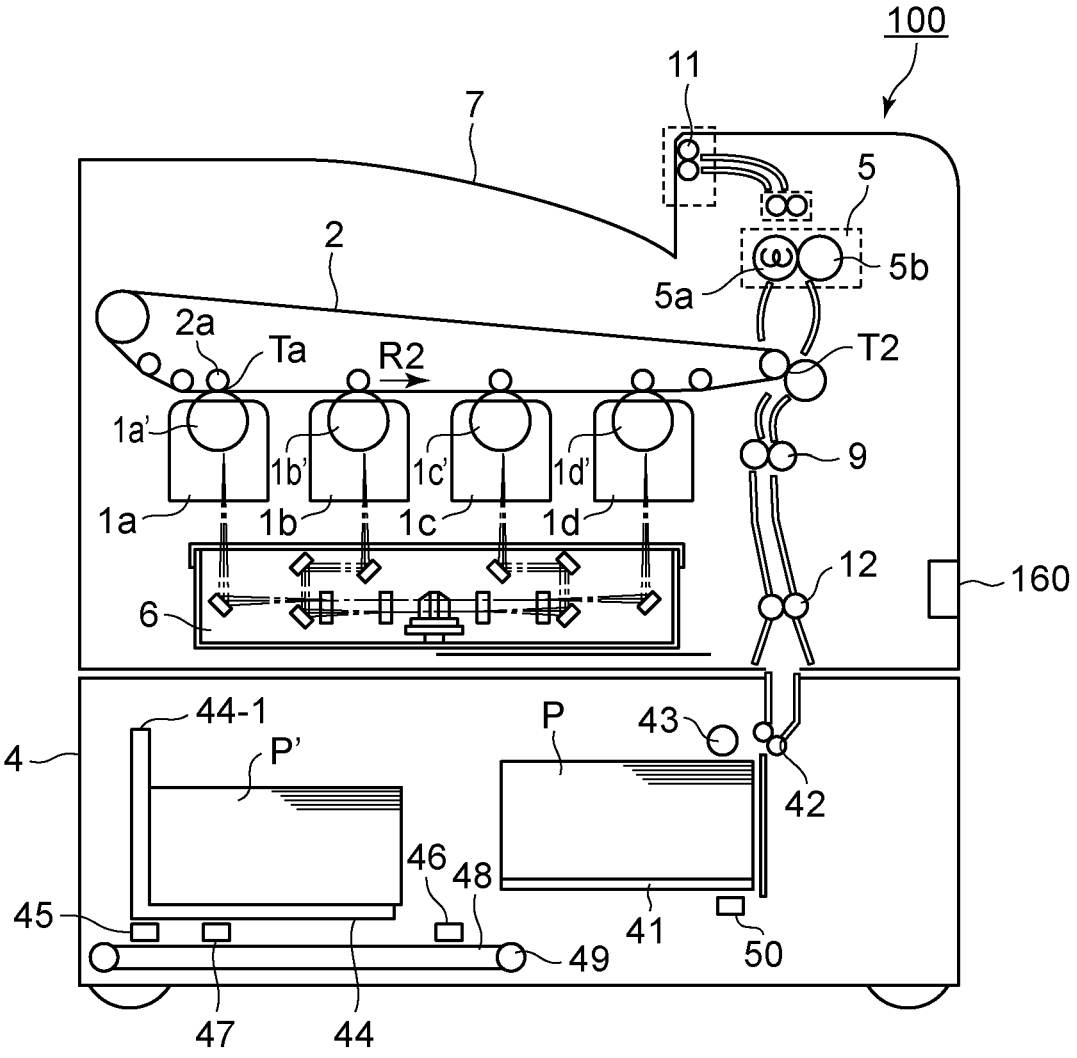
FIG. 1 is a diagram illustrating an exemplary overall configuration of an image forming apparatus.

FIG. 1 illustrates an exemplary overall configuration of an image forming apparatus according to an embodiment of the present invention. An image forming apparatus 100 is a full-color printer of a tandem intermediate transfer system. The image forming apparatus 100 includes image forming units 1*a*, 1*b*, 1*c*, and 1*d* arranged along a lower surface of an intermediate transfer belt 2.

A sheet feeding apparatus 4 feeds sheets P one by one. Conveyance rollers 12 send the sheet P fed from the sheet feeding apparatus 4 to registration rollers 9. The leading edge of the sheet P abuts against the registration rollers 9 which are not rotated, or stopped, thus correcting skew of the sheet. Then, the registration rollers 9 rotate synchronously with the movement (in the direction R2 in FIG. 1) of toner images formed on the intermediate transfer belt 2, and feed the sheet P to a secondary transfer portion T2.

The image forming units 1*a*, 1*b*, 1*c*, and 1*d* have substantially the same configuration, except that developing devices of the respective units use toners of different colors, i.e., yellow, magenta, cyan, and black. The image forming unit 1*a* will be described below.

The image forming unit 1*a* is an electrophotographic process cartridge including a photoconductive drum 1*a*', a charging device, a developing device, and a cleaner. The photoconductive drum 1*a*' rotates at a predetermined process speed in response to driving force transmitted from a drive motor (not illustrated). The photoconductive drum 1*a*' is uniformly charged at a negative potential by the charging device disposed in the image forming unit 1*a*. An exposure device 6 scans a laser beam, modulated based on image data corresponding to an image of each of the different colors, by using a rotary mirror, thus forming an electrostatic latent image on the surface of the charged photoconductive drum 1*a*'. The electrostatic latent image formed on the photoconductive drum 1*a*' is developed with toner by the developing device in the image forming unit 1*a*, thus forming a toner image.

A positive direct current voltage is applied to a primary transfer roller 2*a*, so that the negative toner image on the photoconductive drum 1*a*' is transferred to the intermediate transfer belt 2 in a primary transfer portion Ta. In the other image forming units 1*b*, 1*c*, and 1*d*, toner images of the other colors are similarly formed and the formed toner images are transferred to the intermediate transfer belt 2.

The toner images of the four colors transferred in superposed relationship on the intermediate transfer belt 2 are transferred to the sheet P conveyed to the secondary transfer portion T2. After that, the sheet P is conveyed to a fixing device 5.

The fixing device 5 presses a pressing roller 5*b* against a fixing roller 5*a* including a heater to provide heating nip part. The toner images on the sheet P are heated and pressed in the heating nip part, so that the toner images are fixed to the sheet P.

After that, the sheet P is discharged to a discharge tray 7 by discharging rollers 11.

The image forming apparatus 100 includes a power switch 160. Turning off the power switch 160 stops power supply to the entire image forming apparatus 100.

The sheet feeding apparatus 4 includes a feeding mechanism including feeding rollers 42 and a pickup roller 43. The sheet feeding apparatus 4 separates the uppermost sheet from a bundle of sheets P stacked on a feed tray 41, and feeds the sheet. Since the amount of sheets P on the feed tray 41 decreases as the sheets are fed, the feed tray 41 moves upward at predetermined timing so that the uppermost sheet is positioned at a predetermined level. This enables a sheet feed operation to be continuously performed.

A supply tray 44 is disposed adjacently to the feed tray 41. The supply tray 44 receives a stack of supply sheets P', which are to be supplied to the feed tray 41 when sheets on the feed tray 41 are used up. Whether sheets are stacked on the feed tray 41 is determined by a feed-tray sheet sensor 50, serving as a feed sheet detecting unit. The supply tray 44 is fastened at one end to a belt 48 wound around and stretched between supply-tray driving rollers 49. A supply-tray moving motor 307 (not illustrated) drives the supply-tray driving rollers 49, thus moving the supply tray 44 horizontally. Specifically, the supply tray 44, the supply-tray moving motor 307, and the supply-tray driving rollers 49 function as a sheet mover for moving sheets stacked on the supply tray 44. The supply tray 44 has a wall 44-1 that regulates an end face of the bundle of stacked sheets.

Figure 2A:
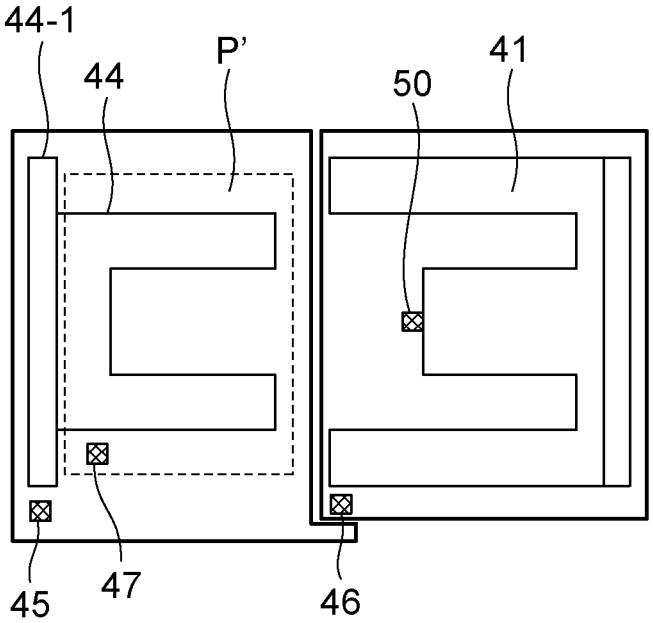
FIGS. 2A and 2B are schematic diagrams explaining a sheet stacking table and the bottom shape of a supply tray in a sheet feeding apparatus.
Figure 2B:
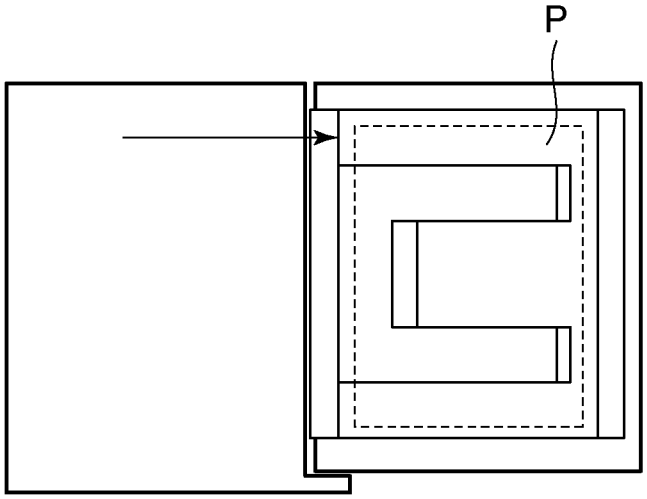

FIGS. 2A and 2B are plan views of the sheet feeding apparatus 4. The feed tray 41 and the supply tray 44 are comb-shaped in plan view so that these trays are engaged with each other. The feed tray 41 is moved downward to the same level as that of a bottom surface of the supply tray 44, and the supply tray 44 is then translated by the supply-tray driving rollers 49, so that the supply tray 44 is moved from a supply standby position in FIG. 2A to a supply position in FIG. 2B. Consequently, the feed tray 41 and the supply tray 44 are engaged with each other to integrate their sheet stacking surfaces with each other. As illustrated in left part of FIG. 2A, the supply tray 44 is on standby at the supply standby position so that a user can supply sheets P'. This standby position corresponds to a home position (HP) of the supply tray 44. A supply-tray HP sensor 45 detects whether the supply tray 44 is located at the HP. In other words, the supply-tray HP sensor 45 functions as a standby position detecting unit. When the sheet stacking surface of the feed tray 41 having no sheet P thereon is moved downward to the same level as that of the sheet stacking surface of the supply tray 44 and the supply tray 44 having sheets stacked thereon is on standby at the HP, the supply tray 44 can be moved. Whether sheets are stacked on the supply tray 44 is determined by a supply-tray sheet sensor 47, serving as a supply sheet detecting unit.

When the supply tray 44 is detected by a supply position sensor 46 during movement of the supply tray 44 to the feed tray 41, the movement of the supply tray 44 is stopped. Specifically, the supply position sensor 46 functions as a sensor that detects the arrival of the supply tray 44 at the supply position. When the supply position sensor 46 detects the supply tray 44, a sheet supply operation is completed. The supply tray 44 is returned to the HP. After the supply tray 44 is moved away from the supply position, the sheets remain on the feed tray 41. If the supply tray 44 reaches the supply position, sheets can be fed from the feed tray 41 before the supply tray 44 is returned to the HP. The reason is that the stacking surface of the supply tray 44 can be engaged with that of the feed tray 41 without any interference as illustrated in FIGS. 2A and 2B.

The sheet feeding apparatus 4 can be pulled out of the image forming apparatus 100 and be moved toward the user in front of the apparatus. As the sheet feeding apparatus 4 is pulled toward the user, the supply tray 44 and the feed tray 41 are also pulled toward the user. The user can supply sheets P' to the pulled-out supply tray 44. The user can also supply sheets P directly to the pulled-out feed tray 41.

Figure 3:
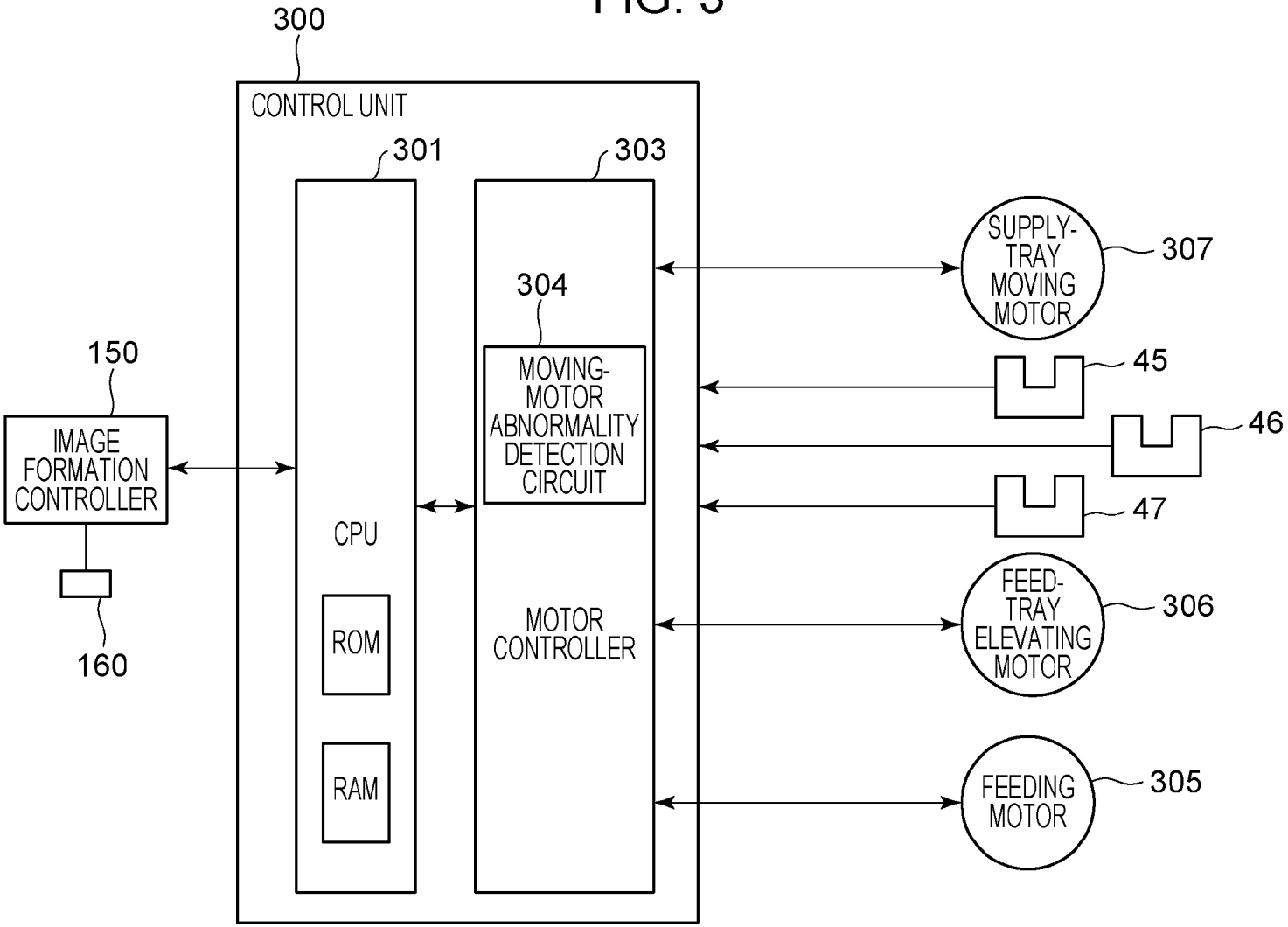
FIG. 3 is a block diagram illustrating a control unit of the sheet feeding apparatus.

FIG. 3 is a block diagram illustrating an exemplary configuration of the sheet feeding apparatus 4 of the image forming apparatus. A control unit 300 communicates with an image formation controller 150 that controls the main body of the image forming apparatus, and operates based on an instruction from the image formation controller 150. The control unit 300 includes a central processing unit (CPU) 301. The CPU 301 executes a predetermined sheet feed operation in accordance with a program stored in a read-only memory (ROM) included in the CPU. The CPU 301 includes a random access memory (RAM) to store data to be temporarily or permanently stored. For example, a motor drive control set value to be input to a motor controller 303 is stored in the RAM.

The motor controller 303 is connected to a feeding motor 305, a feed-tray elevating motor 306, the supply-tray moving motor 307, the supply-tray HP sensor 45, the supply position sensor 46, and the supply-tray sheet sensor 47. The feeding motor 305 rotates and drives the feeding rollers 42 and the pickup roller 43. The feed-tray elevating motor 306 moves the feed tray 41 upward or downward. The supply-tray moving motor 307 rotates the supply-tray driving rollers 49 to translate the supply tray 44. The motor controller 303 properly controls the rotation of each of the motors in accordance with a command from the CPU 301. The motor controller 303 includes a moving-motor abnormality detection circuit 304 for detecting an abnormal state of the supply-tray moving motor 307.

When the last sheet on the feed tray 41 is fed and the absence of a sheet on the feed tray 41 is detected by the feed-tray sheet sensor 50, the CPU 301 allows the feed-tray elevating motor 306 to move the feed tray downward in response to the detection. Then, the CPU 301 allows the supply-tray moving motor 307 to move the supply tray 44 to the supply position, thereby moving sheets onto the feed tray 41. While the absence of a sheet on the supply tray 44 is detected by the supply-tray sheet sensor 47, the CPU 301 does not allow movement of the supply tray 44.

The supply-tray sheet sensor 47 is disposed on a bottom surface of the sheet feeding apparatus 4. The supply-tray sheet sensor 47 can detect the presence or absence of a sheet at the supply standby position if the supply tray 44 is located at the supply position. For example, if the user pulls the sheet feeding apparatus 4 in which the supply tray 44 is located at the supply position, or if the user stacks sheets at the supply standby position after manually moving the supply tray 44 from the standby position to the supply position, the presence of sheets can be detected.

Figure 4:
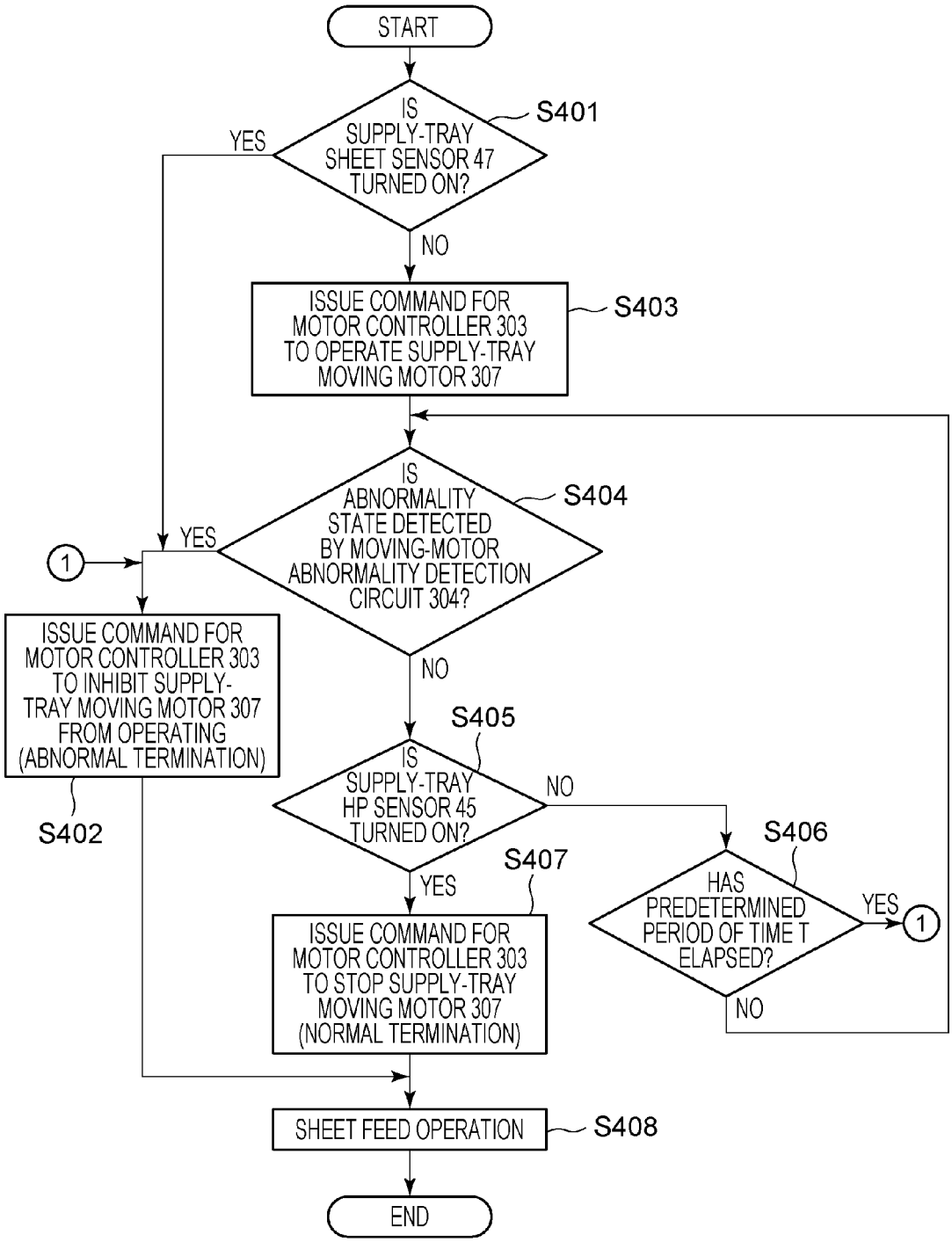
FIG. 4 is a schematic diagram explaining a flowchart of control on a home position (HP) return operation of a supply tray and the start of a sheet feed operation in an embodiment.

Control on a HP return operation of the supply tray 44 by the CPU 301 will now be described with reference to a flowchart of FIG. 4. The CPU 301 allows the supply-tray sheet sensor 47 to determine whether sheets P' are present in a return direction of the supply tray 44 while the supply tray 44 is absent at the HP (S401). In this case, not the presence or absence of sheets on the supply tray 44 but the presence or absence of sheets at the supply standby position is determined. If the sheets P' are present at the supply standby position, the supply tray 44 returning to the HP would collide with the sheets P'. The CPU 301 issues a command for the motor controller 303 to inhibit the supply-tray moving motor 307 from operating (S402).

If the absence of a sheet is determined in S401, the CPU 301 issues a command for the motor controller 303 to operate the supply-tray moving motor 307 (S403). Then, the CPU 301 determines whether an abnormal state (e.g., a motor overload state caused by the presence of foreign matter) is detected by the moving-motor abnormality detection circuit 304 in the motor controller 303 (S404). Such an overload state is detected when, for example, a current flowing through the motor is at or above a predetermined value. When an abnormality is detected, the CPU 301 issues a command for the motor controller 303 to inhibit the supply-tray moving motor 307 from operating (S402).

If any abnormality is not detected in S404, the CPU 301 allows the supply-tray HP sensor 45 to determine whether the supply tray 44 is returned and located at the HP (S405). If the supply tray 44 is absent at the HP, the CPU 301 determines whether a predetermined period of time T or longer has elapsed after the issue of the command in S403 (S406).

If the predetermined period of time T has elapsed, the CPU 301 determines the occurrence of an abnormality in the movement of the supply tray, that is, the supply tray has not been returned to the HP within the predetermined period of time T. The CPU 301 issues a command for the motor controller 303 to inhibit the supply-tray moving motor 307 from operating (S402). If the predetermined period of time T has not elapsed, the CPU 301 repeats steps S404 and S405 until the supply tray 44 is returned to the HP (that is, the supply-tray HP sensor 45 is turned on), or the predetermined period of time T has elapsed. If the supply-tray HP sensor 45 is turned on within the predetermined period of time T, it means that the supply tray 44 is returned to the HP (normal termination). The CPU 301 issues a command for the motor controller 303 to stop the supply-tray moving motor 307 (S407).

If the supply tray 44 is not returned to the HP, it will not affect upward or downward movement of the feed tray 41. The sheets P can be fed from the feed tray 41. If an abnormality occurs in the movement of the supply tray 44, it is therefore unnecessary to inhibit the operation of the entire sheet feeding apparatus 4. The CPU 301 permits the operation of feeding a sheet from the feed tray 41, irrespective of whether the HP return operation of the supply tray 44 has been terminated normally or abnormally. The CPU 301 allows the sheet feed operation in response to a sheet feed instruction from the image formation controller 150 (S408).

In the present embodiment, the control on the HP return operation of the supply tray 44 and the start of the sheet feed operation have been described. In some embodiments, the CPU 301 stops the operation of the supply tray 44 in response to detection of an abnormal state in which the supply tray 44 is not moved to the supply position in the sheet supply operation. Specifically, if the supply position sensor 46 does not detect the supply tray 44 while the CPU 301 allows the supply-tray moving motor 307 to be driven in order to move the supply tray 44 to the supply position, the CPU 301 determines the occurrence of an abnormality in the movement of the supply tray. In this case, if the user supplies sheets to the feed tray 41, the sheets can be fed from the feed tray 41.

In the foregoing embodiment, the sheet feeding apparatus 4 is configured such that the supply tray 44 is moved. In some embodiments, the sheet feeding apparatus 4 is configured such that not the whole of the supply tray 44 but the wall 44-1 of the supply tray 44 excluding the bottom thereof is moved. Specifically, the wall 44-1 presses a bundle of sheets stacked on the supply tray 44 to the feed tray 41, thus supplying the bundle of sheets to the feed tray 41. In such a configuration, the supply-tray moving motor 307 moves the wall 44-1 by using the supply-tray driving rollers 49. In other words, the wall 44-1, the supply-tray moving motor 307, and the supply-tray driving rollers 49 function as a sheet mover that moves sheets.

According to the present embodiment, if the sheet mover moving sheets stacked on the supply tray 44 has an abnormality, the sheet feed operation can be continued without turn-off and -on of the power switch 160 of the image forming apparatus. This increases the ease of operation of the sheet feeding apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-176859, filed Sep. 8, 2015, which is hereby incorporated by reference herein in its entirety.

What is claimed is:

1. A sheet feeding apparatus comprising:
a first tray configured to store sheets;
a sheet feeder configured to feed sheets stored on the first tray;
a first sheet sensor configured to detect presence or absence of a sheet on the first tray;
a second tray configured to store sheets, to be supplied to the first tray, wherein the second tray is disposed adjacently to the first tray;
a sheet mover configured to move the sheets stored on the second tray, wherein the sheet mover is movable between a first position for storing sheets on the second tray and a second position for supplying the sheets stored on the second tray to the first tray;
an abnormality detector configured to detect an abnormality in the sheet mover; and
a controller configured to control,
in a case where the abnormality detector detects an abnormality in the sheet mover, to inhibit the sheet mover from operating, and
in a case where the first sheet sensor detects a sheet after the abnormality detector detects the abnormality, to permit the sheet feeder to feed a sheet.

2. The sheet feeding apparatus according to claim 1,
wherein the sheet mover includes a moving member and a motor configured to move the moving member, and
wherein, to move the sheets stored on the second tray, the motor moves the moving member.

3. The sheet feeding apparatus according to claim 2, wherein, in a case where the motor is in an overload state, the abnormality detector determines that the sheet mover has an abnormality.

4. The sheet feeding apparatus according to claim 1, further comprising a second sheet sensor configured to detect whether a sheet is present on the second tray, wherein, in a case where the first sheet sensor detects that a sheet is absent on the first tray and the second sheet sensor detects that sheets are present on the second tray, the sheet mover moves the sheets stored on the second tray to the first tray.

5. The sheet feeding apparatus according to claim 1, further comprising:

a first position sensor configured to detect the sheet mover located at the first position; and a second sheet sensor configured to detect whether sheets are present on the second tray, wherein, in a case where the second sheet sensor detects sheets while the first position sensor does not detect the sheet mover located at the first position, the abnormality detector determines that the sheet mover has an abnormality.

6. The sheet feeding apparatus according to claim 1, further comprising a first position sensor configured to detect the sheet mover located at the first position, and wherein, in a case where the first position sensor does not detect the sheet mover located at the first position after the sheet mover starts moving from the second position to the first position, the abnormality detecting unit determines that the sheet mover has an abnormality.

7. The sheet feeding apparatus according to claim 1, further comprising a second position sensor configured to detect the sheet mover located at the second position, wherein, in a case where the second position sensor does not detect the sheet mover located at the second position after the sheet mover starts moving from the first position to the second position, the abnormality detector determines that the sheet mover has an abnormality.

8. A sheet feeding apparatus comprising:

a first tray configured to store sheets;

a sheet feeder configured to feed sheets stored on the first tray;

a second tray configured to store sheets, to be supplied to the first tray;

a sheet sensor configured to detect presence or absence of a sheet on the second tray;

a sheet mover configured to move the sheets stored on the second tray, wherein the sheet mover is movable between a first position for storing sheets on the second tray and a second position for supplying the sheets stored on the second tray to the first tray;

a first position sensor configured to detect the sheet mover located at the first position;

an abnormality detector configured to detect an abnormality in the sheet mover, wherein, in a case where the sheet sensor detects sheets while the first position sensor does not detect the sheet mover located at the first position, the abnormality detector determines that the sheet mover has an abnormality; and a controller configured to control, in a case where the abnormality detector detects an abnormality in the sheet mover, to inhibit the sheet mover from operating and to permit the sheet feeder to feed a sheet.

9. The sheet feeding apparatus according to claim 8, wherein, in a case where the first position sensor does not detect the sheet mover located at the first position after the sheet mover starts moving from the second position to the first position, the abnormality detecting unit determines that the sheet mover has an abnormality.

10. The sheet feeding apparatus according to claim 8, further comprising a second position sensor configured to detect the sheet mover located at the second position, wherein, in a case where the second position sensor does not detect the sheet mover located at the second position after the sheet mover starts moving from the first position to the second position, the abnormality detector determines that the sheet mover has an abnormality.

11. An image forming apparatus comprising:

a first tray configured to store sheets;

a sheet feeder configured to feed sheets stored on the first tray;

a first sheet sensor configured to detect presence or absence of a sheet on the first tray;

an image forming unit configured to form an image on a sheet fed by the sheet feeder;

a second tray configured to store sheets, to be supplied to the first tray, wherein the second tray is disposed adjacently to the first tray;

a sheet mover configured to move the sheets stored on the second tray, wherein the sheet mover is movable between a first position for storing sheets on the second tray and a second position for supplying the sheets stored on the second tray to the first tray;

an abnormality detector configured to detect an abnormality in the sheet mover; and a controller configured to control, in a case where the abnormality detector detects an abnormality in the sheet mover, to inhibit the sheet mover from operating, and in a case where the first sheet sensor detects a sheet after the abnormality detector detects the abnormality, to permit the sheet feeder to feed a sheet and permit the image forming unit to form an image.

* * * * *